US005164658A

United States Patent [19]

Kuwahara

[11] Patent Number: 5,164,658

[45] Date of Patent: Nov. 17, 1992

[54] CURRENT TRANSFER CIRCUIT

[75] Inventor: Hisao Kuwahara, Kamakura, Japan

[73] Assignee: Kabushiki Kaisha Toshiba, Kawasaki, Japan

[21] Appl. No.: 693,602

[22] Filed: Apr. 30, 1991

[30] Foreign Application Priority Data

May 10, 1990 [JP] Japan ..... 2-120594

[51] Int. Cl.[5] ..... G05F 3/26

[52] U.S. Cl. ..... 323/315; 307/296.1; 307/296.6

[58] Field of Search ..... 323/315, 316, 317; 307/296.1, 296.6

[56] References Cited

U.S. PATENT DOCUMENTS 4,578,633 3/1986 Aoki ..... 323/315

*Primary Examiner*—Emanuel T. Voeltz

*Attorney, Agent, or Firm*—Banner, Birch, McKie & Beckett

[57] ABSTRACT

An integrated circuit comprising circuits such as current mirror circuits, and designed to supply a current from a current source to a load. The circuit comprises two current mirror circuits, two transistors, a current source, and a load. Either current mirror circuit has a power-supply terminal, an input terminal and an output terminal. Either transistor has two ends and an input terminal. The current source has two ends, an the load also has two ends. The current source is connected at the first end to a first power source, and at the second end to the input terminal of the first transistor. The first transistor is coupled at the first end to a second power source, and at the second end to the input terminal of the first current mirror circuit. The first current mirror circuit has its power-supply terminal coupled to the first power source, and its output terminal coupled to the input terminal of the second current mirror circuit. The second current mirror circuit has its power-supply terminal coupled to the second power source, and its output terminal coupled to the node of the input terminal of the first transistor and the second end of said current source. The second transistor has its input terminal connected so that of the first transistor, its first end coupled to the second power source, and its second end connected to the first end of the load. The other end of the load is coupled to the first power source.

16 Claims, 4 Drawing Sheets

CURRENT TRANSFER CIRCUIT

BACKGROUND OF THE INVENTION

1. Field of the Invention

The present invention relates to a current transfer circuit for transferring output current corresponding to input current to a load circuit like a current mirror circuit.

2. Description of the Related Art

A bipolar monolithic IC frequently uses a current mirror circuit as a bias circuit or signal transfer circuit. Especially, a very-low-voltage operating IC with the operating supply voltage of 1 [V] or lower uses a simple current mirror circuit shown in FIG. 1.

The current mirror circuit CM10 comprises PNP transistors Q11 and Q12, both having their emitters connected to the high-potential power source $V_{CC}$, and their bases connected to each other. The collector of the transistor Q11 is coupled to the base of the transistor Q11 and also to the input/output terminal A. The collector of the transistor Q12 is connected to the second input/output terminal B.

The first input/output terminal A functions as an input terminal, for example, which is connected to an input current source I10. The second input/output terminal B functions as an output terminal, for example, which is connected to a load circuit L10.

In the load circuit L10, a current mirror circuit comprising NPN-type transistors Q13 and Q14 is shown as an example.

For the circuit having the above configuration, only the transistors Q12 and Q13 are connected in series between high-potential power source $V_{CC}$ and low-potential power source $V_{SS}$. Therefore, because there is only a small voltage drop, low-voltage operations can be executed. The operations of the above current mirror circuit CM10 are described below.

First, the base potentials of the PNP-type transistors Q11 and Q12 are decreased by the current $I_{in}$ obtained from the input current source I10. Thus, the transistors Q11 and Q12 are conducted respectively. In this case, if it is assumed that the characteristic of the transistor Q11 equals that of the transistor Q12, the voltage $V_{BE}$ between the base and emitter and the collector current Ic are theoretically the same for the both transistors.

However, a bipolar monolithic IC obtained by forming PNP-type and NPN-type transistors on the same substrate uses a P-type substrate in order to keep the substrate at the ground potential. Therefore, the NPN-type transistor is the so-called vertical type in which base-emitter junction and base-collector junction are vertically formed, while the PNP-type transistor is the so-called lateral type in which base-emitter junction and base-collector junction are horizontally formed. The lateral PNP-type transistor has smaller emitter grounded current amplification factor $\beta_p$ and smaller Early voltage $V_A$ to determine the so-called "Early effect" in which fluctuation of the voltage $V_{CE}$ between the collector and emitter influences the collector current Ic than the vertical NPN-type transistor.

Therefore, the error $\epsilon$ between the input current Iin and output current Iout or the Iout change rate $\Delta$ due to the fluctuation of supply voltage which does not matter for the current mirror circuit comprising vertical-type transistors more remarkably appear and become an issue for the current mirror circuit comprising lateral-type transistors.

This point is described below.

First, the emitter grounded current amplification factor $\beta_p$ dependency of the current mirror circuit CM10 shown in FIG. 1 is considered below.

When the emitter grounded current amplification factors of the transistors Q11 and Q12 are assumed as $\beta_p$ and the input current of the current mirror circuit CM10 as $I_{in}$, the output current Iout is obtained as follows:

$$Iout = Iin/\{1+(2/\beta_p)\} \quad (1)$$

However, Early effect is ignored in the expression (1) in order to simplify the calculation.

When the value of $\beta_p$ is assumed as 20 in the expression (1), $I_{out}$ is obtained as approx. $0.91.I_{in}$ and the error $\epsilon$ between input and output is obtained as follows:

$$\begin{aligned}\epsilon &= (I_{out} - I_{in})/I_{in}\\ &= -0.09\\ &= -9\%\end{aligned}$$

Iout is obtained as a value approximately 9% smaller than $I_{in}$.

Then, the supply voltage dependency of the current mirror circuit CM10 shown in FIG. 1 is considered below.

When the supply voltage is assumed as $V_{CC}$, the Early voltage of the transistors Q11 and Q12 as $V_A$, the collector voltage to the emitter of the transistor Q11 as $V_{CE11}$, and the base voltage to the emitter of the transistor Q13 as $V_{BE13}$; the output current Iout is obtained as follows:

$$Iout = Iin\ (V_A + V_{CC} - V_{BE13})/(V_A - V_{CE11}) \quad (2)$$

The emitter grounded current amplification factor $\beta_p$ is ignored in the expression (2) in order to simplify the calculation.

When the value of $V_A$ is assumed as 10 [V], $V_{BE13}$ as 0.7 [V], and $V_{CE11}$ as −0.7 [V] in the expression (2); $I_{out}(V_{CC}=1)$ is approx. $0.96.I_{in}$ when VCC is 1 [V], for example, and Iout, $(V_{CC}=2)$ is approx. $1.09.I_{in}$ when $V_{CC}$ is 2 [V], for example.

When $V_{CC}$ changes from 1 to 2 [V] in the expression (2), the change rate $\Delta$ of the above Iout is obtained as follows:

$$\begin{aligned}\Delta &= \{I_{out}(V_{CC}=2) - I_{out}(V_{CC}=1)\}/\{I_{out}(V_{CC}=1)\}\\ &= 0.14\\ &= 14\%\end{aligned}$$

When $V_{CC}$ changes from 1 to 2 [V], for example, $I_{out}$ changes by approximately 14%.

For the current mirror circuit having the above configuration, as mentioned above, there is a problem that, if a circuit comprises lateral-type transistors, the error $\epsilon$ between Iin and Iout and the Iout change rate $\Delta$ due to the supply voltage fluctuation increase because the emitter grounded current amplification factor $\beta_p$ and the Early voltage $V_A$ are small. Therefore, no high accuracy cannot be obtained from the circuit shown in FIG. 1 especially when low-voltage operations are executed.

SUMMARY OF THE INVENTION

The present invention is made to solve the above problem and it is an object of this invention to provide a current transfer circuit for transferring output current corresponding to input current like a current mirror circuit, wherein the above current transfer circuit can operate at a low voltage and minimize the error between output and input current and the change rate of the output current due to the supply voltage fluctuation.

To achieve this object, a semiconductor integrated circuit according to the present invention comprises:

first current mirror circuit having an input terminal, output terminal, and power source terminals, wherein the power source terminal is connected with the first power source;

a current source having one end and the other end, wherein one end is connected with the output terminal of said current mirror circuit and the other end is connected with the second power source;

second current mirror circuit having an input terminal, output terminal, and power source terminal, wherein the power source terminal is connected with said second power source and the output terminal is connected with the input terminal of said first current mirror circuit;

first transistor having one end, the other end, and an input terminal, wherein one end is connected with said first power source, the other end is connected with the input terminal of said second current mirror circuit, and the input terminal is connected between the output terminal of said first current mirror circuit and one end of said power source;

second transistor having one end, the other end, and an input terminal, wherein one end is connected with said first power source and the input terminal is connected with the input terminal of said first transistor; and a load having one end and the other end, wherein one end is connected with the other end of said second transistor and the other end is connected with said second power source.

The integrated circuit described above has a feedback loop comprised of the first transistor, the first current mirror circuit, and the second current mirror circuit. Hence, feedback operation is achieved in the integrated circuit, thereby reducing the difference between the input current Iin supplied from the current source and the output current Iout supplied to the load.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

There will now be described embodiments of this invention with reference to the accompanying drawings.

First embodiment

Figure 1:
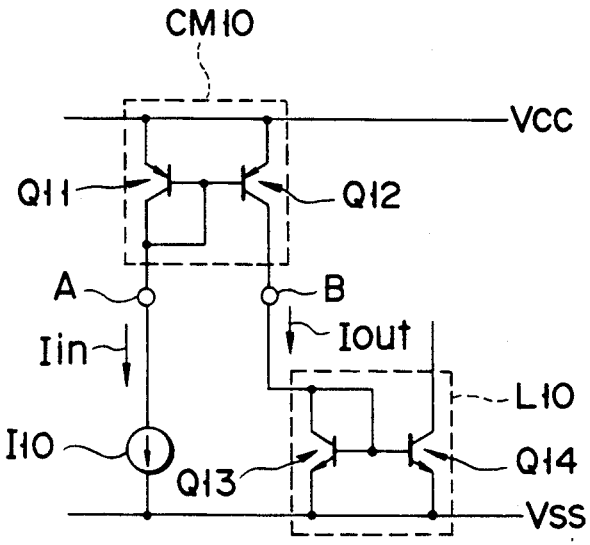
FIG. 1 (PRIOR ART)
FIG. 1 is a diagram showing the existing current transfer circuit.
Figure 2:
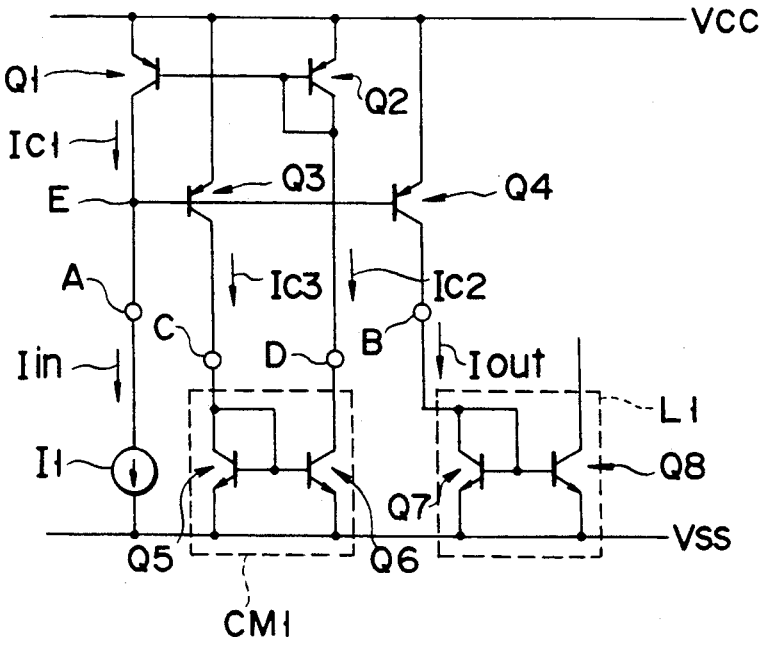
FIG. 2 is a diagram showing a current transfer circuit related to the first embodiment of the present invention.

FIG. 2 is a diagram showing a current transfer circuit related to the first embodiment of the present invention.

As shown in FIG. 2, the emitters of the PNP-type transistors Q1 and Q2 are connected to the high-potential power source VCC and the bases of them are mutually connected in common. The collector of the transistor Q2 is connected to the base. The collector of the transistor Q1 is connected to the first terminal A through the node E. The emitters of the PNP-type transistors Q3 and Q4 are connected to the high-potential power source Vcc and the bases of them are mutually connected in common and connected to the node E. The collector of the transistor Q3 is connected to the third terminal C. The third terminal C is connected to the collector of the NPN-type transistor Q5. The collector of the transistor Q5 is shorted by the base which is connected to the base of the NPN-type transistor Q6 in common. The emitters of the transistors Q5 and Q6 are connected to the low-potential power source $V_{SS}$. The collector of the transistor Q6 is connected to the fourth terminal D which is connected to the collector of the transistor Q2.

The first terminal A functions as an input terminal, for example, which is connected to an input current source I1. The second terminal B functions as an output terminal, for example, which is connected to a load circuit L1. Terminal A and B are hereafter referred to as the input terminal A and the output terminal B respectively.

The third and fourth terminals C and D are connected to a circuit capable of transferring the current corresponding to the current to be supplied to one current supply terminal to the other current supply terminal like a current mirror circuit. As the above circuit, a simple current mirror circuit CM1 comprising the NPN-type transistor Q5 and Q6 whose emitters are connected to the low potential power source $V_{SS}$ is desirable in view of low-voltage operations. Terminal C and D are hereafter referred to as the current input terminal C and the current output terminal D respectively.

The load circuit L1 uses a current mirror circuit comprising the NPN-type transistors Q7 and Q8 as an example.

For operations of the current transfer circuit having the above configuration, the base potentials of the transistors Q3 and Q4 are decreased by the current Iin obtained from the current source I1 and the transistors Q3 and Q4 are conducted.

In this case, the current $I_{C3}$ is supplied to the current input terminal C by the conducted transistor Q3, the transistors Q5 and Q6 connected to the terminal C are conducted, and the current mirror circuit CM1 is driven. Thus, the current $I_{C2}$ equal to the current $I_{C3}$ is supplied to the current output terminal D connected to the collector of the transistor Q6 and the transistors Q1 and Q2 connected to the terminal D are conducted.

When it is assumed that the transistors Q1 and Q2 compose a current mirror circuit and the characteristic of the transistor Q1 is equal to that of the transistor Q2, the current $I_{C1}$ approximately equal to the current $I_{C2}$ flows through the node is connected to the collector of the transistor Q1 and returns to the current Iin when the transistor Q1 is conducted.

That is, the current transfer circuit of the present invention has the feedback route connecting the input terminal A, node E, transistor Q3, current input terminal C, transistor Q5, transistor Q6, current output terminal D, transistor Q2, transistor Q1, and node E and also has negative feedback action.

When it is assumed that the transistors Q3 and Q4 which are simultaneously conducted has the same characteristic, the current $I_{out}$ equal to the current $I_{C3}$ is supplied to the load circuit L1.

Then, the emitter-ground-current amplification factor $\beta_p$ of the above current transfer circuit is considered below.

When the emitter-ground-current amplification factors of the transistors Q1 through Q4 are assumed as $\beta_p$ and the input current of the current transfer circuit as $I_{in}$, the output current Iout is obtained as follows:

$$I_{out}=I_{in}[1+\{4/(\beta_p^2+2\beta_p)\}] \quad (3)$$

The Early effect is ignored in the expression (3) in order to simplify the calculation.

When the value of $\beta_p$ is assumed as 20 (general value for the lateral-type transistor) as usual in the expression (3), Iout comes to approximately $0.991.I_{in}$ and the error $\epsilon$ between input and output is obtained as follows:

$$\begin{aligned}\epsilon &= (I_{out}-I_{in})/I_{in}\\ &= -0.009\\ &= -0.9\%\end{aligned}$$

Therefore, the error $\epsilon$ is improved by about one digit compared with the existing error, which is very small.

Then the supply voltage dependency of the above current transfer current is considered below.

The collector-emitter voltage $V_{CE1}$ of the transistor Q1 is equal to the base-emitter voltage $V_{BE3}$ of the transistor Q3 because the both transistors are connected to the node E. That is, the following expression is effected.

$$V_{CE1}=V_{BE3}$$

The collector-emitter voltage $V_{CE2}$ of the transistor Q2 is equal to the base-emitter voltage $V_{BE2}$ of it because the base and collector are connected in common. That is, the following expression is effected.

$$V_{CE2}=V_{BE2}$$

In this case, because the emitter current of the transistor Q2 is equal to that of the transistor Q3, $V_{BE2}$ is approximately equal to $V_{BE3}$. That is, the following expression is effected.

$$V_{BE2}\approx V_{BE3}$$

Therefore, $$V_{CE1}\approx V_{CE2}$$

When the collector-emitter voltage $V_{CE3}$ of the transistor Q3 is assumed as the supply voltage $V_{CC}$ and the base-emitter voltage of the transistor Q5 is assumed $V_{BE5}$, the following expression is effected.

$$V_{CE3}=V_{BE5}-V_{CC}$$

Similarly, when the collector-emitter voltage $V_{CE4}$ of the transistor Q4 is assumed as the supply voltage $V_{CC}$ and the base-emitter voltage of the transistor Q7 is assumed $V_{BE7}$, the following expression is effected.

$$V_{CE4}=V_{BE7}-V_{CC}$$

In this case, the transistor Q5 is connected between the high-potential power source $V_{CC}$ and the low-potential power source $V_{SS}$ in series with the transistor Q3, and, similarly, the transistor Q7 is connected between the power source $V_{CC}$ and the power source $V_{SS}$ in series with the transistor Q4. That is, the transistors Q5 and Q7 are connected between $V_{CC}$ and $V_{SS}$ under the same condition. Moreover, when it is assumed that the transistors Q3 and Q4 connected to the transistors Q5 and Q7 in series have the same characteristic, $V_{BE5}$ is approximately equal to $V_{BE7}$. That is, the following expression is effected.

$$V_{BE5}\approx V_{BE7}$$

Therefore, $$V_{CE3}\approx V_{CE4}$$

That is, the voltages between the collector and emitter of the transistors Q1 and Q2 to be matched (to be a pair) are approximately the same and, similarly, the voltages between the collector and emitter of the transistors Q3 and Q4 are approximately the same. Therefore, Early effect is canceled in the transistors to be matched and the change rate $\Delta$ of Iout due to the fluctuation of the supply voltage are hardly produced.

Moreover, the minimum operating supply voltage can be very small because only the transistors Q3 and Q5 and the transistors Q4 and Q7 are connected between the operating supply voltage $V_{CC}$ and low supply voltage $V_{SS}$ in series. When the base-emitter junction drop voltage $V_{BE}$ is assumed as 0.7 [V] respectively and emitter-collector saturation voltage $V_{CESAT}$ as 0.1 [V] respectively, for example, the minimum operating supply voltage $V_{CCMIN}$ is expressed by the inequality below.

$$V_{CCMIN} \geqq V_{BE} + V_{CESAT} \geqq 0.8\ [V]$$

Therefore, operations at very low voltage of 1 [V] or lower can be executed.

As mentioned above, the current transfer circuit related to an embodiment of the present invention can be operated by very low voltage of 1 [V] or lower, for example, and the error $\epsilon$ between input and output can be decreased. Moreover, the current transfer circuit can be operated with a very small change rate A of Iout due to the supply voltage fluctuation.

Second Embodiment

Figure 3:
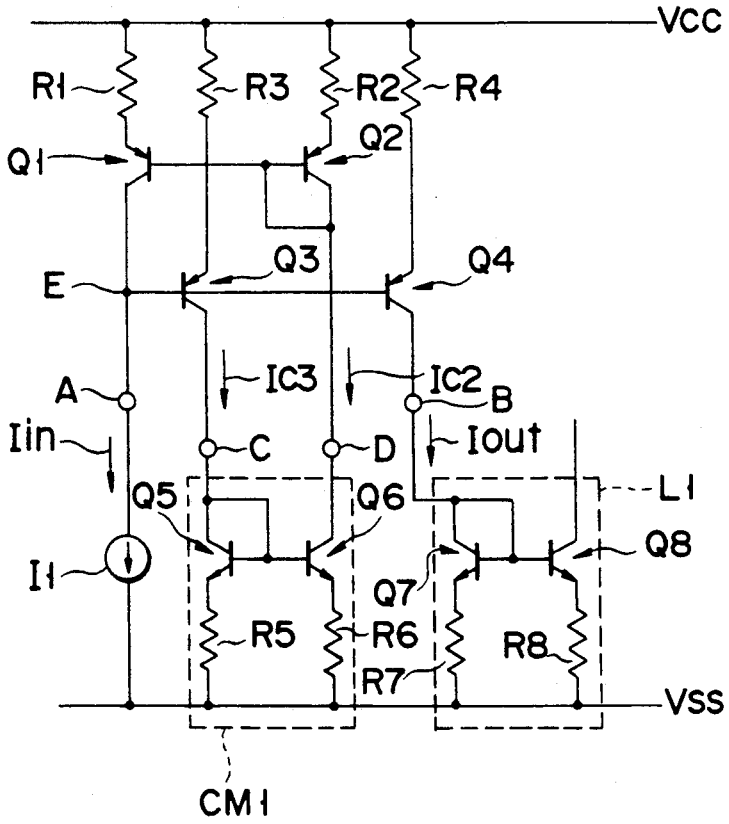
FIG. 3 is a diagram showing a current transfer circuit related to the second embodiment of the present invention.

FIG. 3 is a diagram showing a current transfer circuit related to the second embodiment of the present invention.

As shown in FIG. 3, the circuit is configured so that feedback action will be further improved by connecting resistor R1 through R4 between the emitter and high-potential power source Vcc of the transistors Q1 through Q4 respectively in order to improve the consistency of characteristics of the transistors Q1 and Q2 and the transistors Q3 and Q4.

In this case, if resistances R5 and R6 are connected between the emitter and low-potential power source $V_{SS}$ of the transistors Q5 and Q6 and also resistors R7 and R8 are connected between the emitter and power source $V_{SS}$ of the transistors Q7 and Q8 composing the load circuit L1 respectively, the transistor consistency is further improved in these circuits.

Third Embodiment

Figure 4:
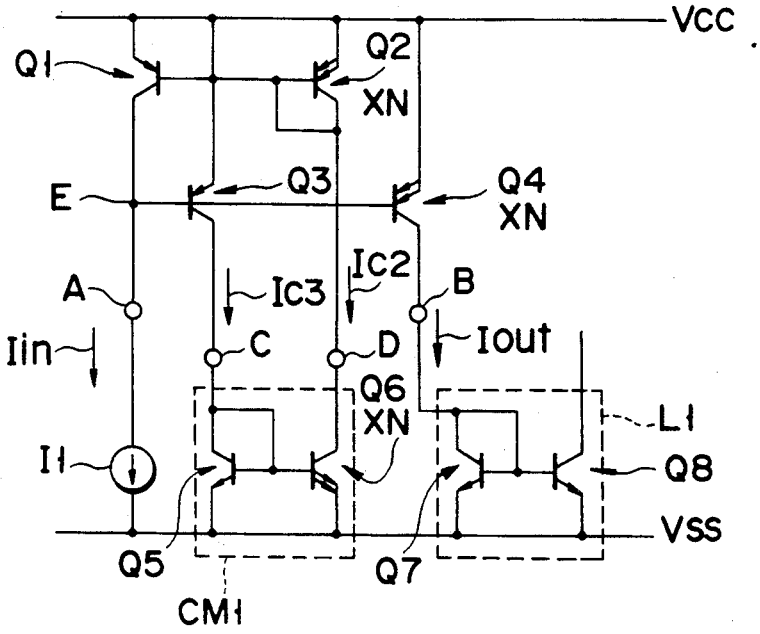
FIG. 4 is a diagram showing a current transfer circuit related to the third embodiment of the present invention.

FIG. 4 is a diagram showing a current transfer circuit related to the third embodiment of the present invention.

As shown in FIG. 4, if the ratio of emitter areas of the transistors Q1 and Q2 and the transistors Q3 and Q4 to be matched is set to "1 :N", current can be transferred by setting the ratio of the input current $I_{in}$ to the output current $I_{out}$ to "1 :N", for example.

In this case, for example, it is more preferable to control the ratio of the current $I_{C3}$ supplied to the current input terminal C to the current $I_{C2}$ supplied to the current output terminal D at "1 :N" by also setting the ratio of emitter areas of the transistors Q5 and Q6 composing the current mirror circuit CM1 to "1 :N".

For the circuit shown in FIG. 4, when the emitter areas of the transistors Q1, Q3, and Q5 are set to 1, the emitter areas of the transistors Q2, Q4, and Q6 to be matched are multiplied by "N" respectively.

The current transfer circuit related to the present invention can also be realized by combining the above first through third embodiments.

It is preferable to operate the current transfer circuit related to the present invention by setting conditions so that the collector voltages $V_{CE3}$ and $V_{CE4}$ to each emitter of the transistors Q3 and Q4 will be approximately equal. For example, conditions are set so that the voltage drop between the current input terminal C and low supply voltage $V_{SS}$ will be equal to that between the current output terminal B and low supply voltage $V_{SS}$.

FIGS. 2 through 4 show an example of preferable operating conditions in which the transistor Q5 connected between the collector of the transistor Q3 and the low-potential power source $V_{SS}$ and the transistor Q7 connected between the collector of the transistor Q4 and the low-potential power source $V_{SS}$ are configured with the same dimension.

When resistors are connected between the transistors Q3 and Q5 and between the transistors Q4 and Q7 respectively though they are not illustrated, it is preferable to equalize the resistance values.

Therefore, when the current transfer circuit related to the present invention is operated by equally setting the collector voltages $V_{CE3}$ and $V_{CE4}$ of the transistors Q3 and Q4, the best effect can be obtained for the supply voltage dependency or the $I_{out}$ change rate $\Delta$ due to the supply voltage fluctuation.

Figure 5:
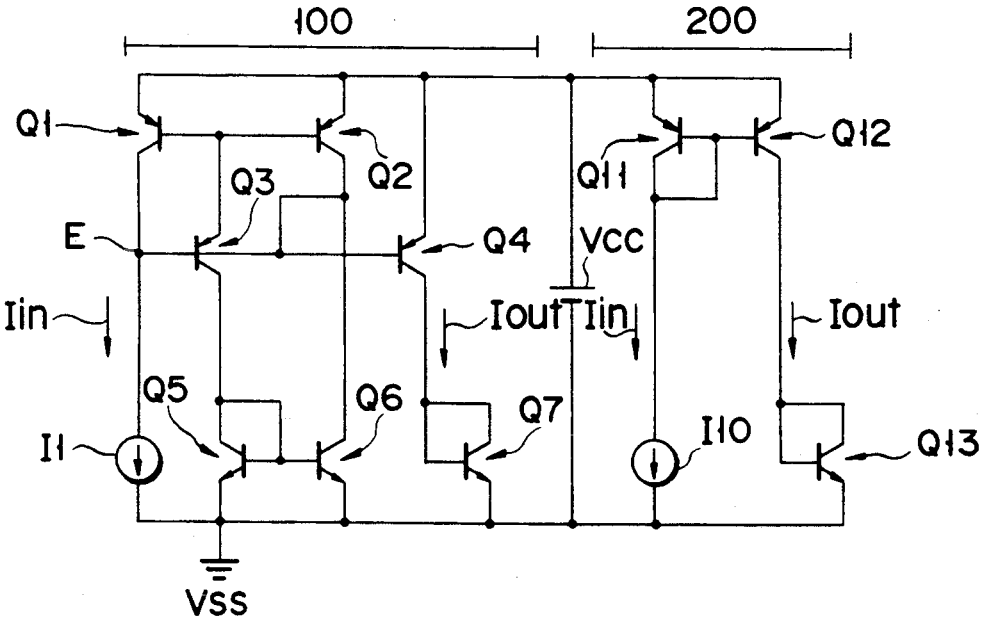
FIG. 5 is a diagram showing a circuit used for the simulation to compare the current transfer circuit related to the present invention with the existing current transfer circuit.
Figure 6:
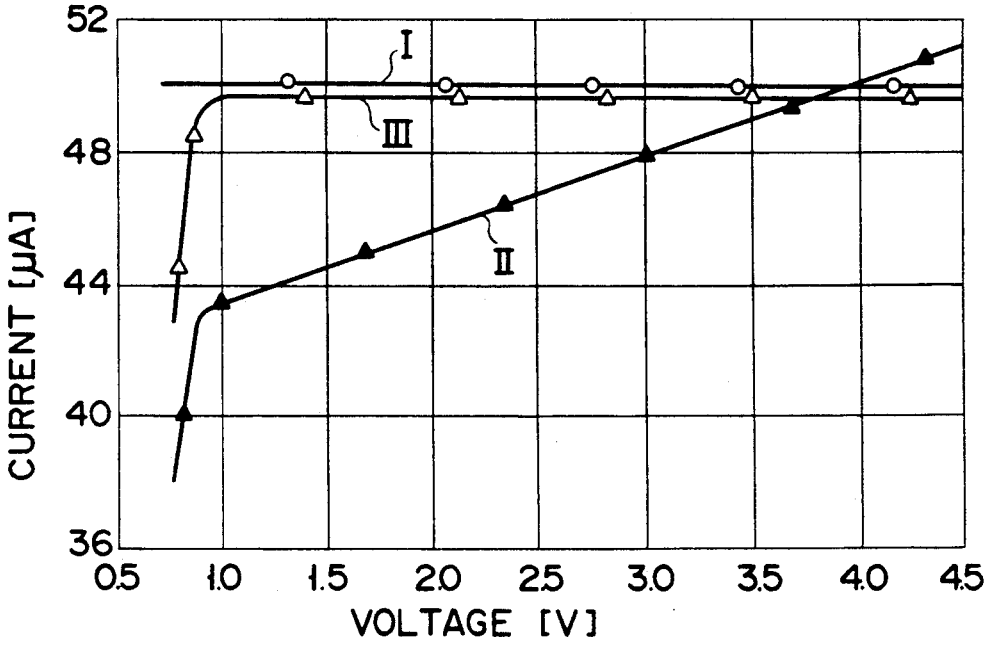
FIG. 6 is a diagram showing the supply voltage dependency of the current transfer circuit made according to the simulation result.
Figure 7:
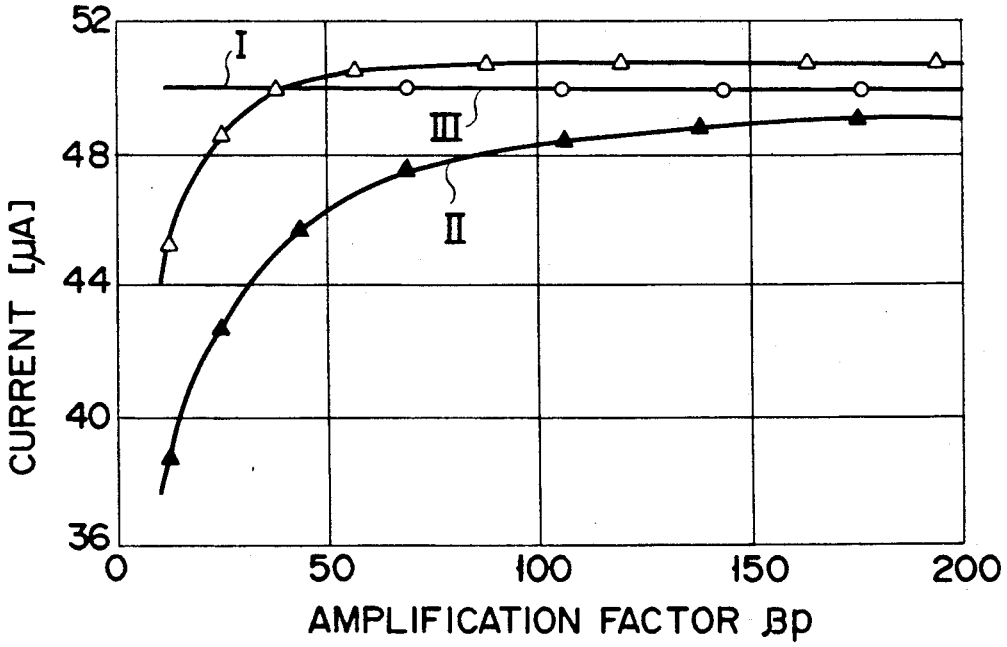
FIG. 7 is a diagram of the current transfer circuit made according to the simulation result.

The following is the description of the results of simulating the current transfer circuit related to the present invention and the existing current mirror circuit by a computer, according to FIGS. 5 through 7.

FIG. 5 is a diagram of the simulated circuit. As shown in FIG. 5, the range specified by the reference symbol 100 shows a circuit related to the present invention and specified by the reference symbol 200 shows the existing circuit. In FIG. 5, the device connection state is provided with the same symbol as those in FIGS. 1 through 4 but the description of it is omitted.

FIG. 6 is a diagram showing the result of simulation related to the supply voltage $V_{CC}$ dependency, in which the vertical axis represents the value of the input current $I_{in}$ or output current Iout and the horizontal axis represents the value of the supply voltage $V_{CC}$. The characteristic of each transistor is set as follows:

The characteristic of each transistor is set as follows:

The emitter grounded current amplification factor $\beta_p$ of the PNP-type transistors Q1, Q2, Q3, Q4, Q11, and Q12 is set to 30 respectively.

The emitter grounded current amplification factor $\beta_p$ of the NPN-type transistors Q5, Q6, and Q13 is set to 150 respectively.

The input current Iin generated by I1 and I10 is set to 50 [$\mu$A] respectively.

As shown in FIG. 6, the input current Iin shown by the line I is constantly kept at 50 [$\mu$A] independently of the fluctuation of the supply voltage $V_{CC}$ because it is generated by the constant current sources I1 and I10.

For the existing circuit, the output current Iout shown by the line II tends to increase as the supply voltage $V_{CC}$ rises. The increase rate is approx. 4 [%/V].

For the circuit related to the present invention, however, the current shown by the line III tends to level off around the input current Iin of 50 [$\mu$A] within the range of the supply voltage $V_{CC}$ of approx. 0.9 to 4.5 [V] even if the supply voltage $V_{CC}$ rises.

Therefore, for the circuit related to the present invention, the result is obtained from the simulation that the fluctuation of the output current $I_{out}$ to that of the supply voltage $V_{CC}$ (i.e. change rate) and the supply voltage dependency are small.

FIG. 7 is a diagram showing the result of simulation related to the emitter grounded current amplification factor $\beta_p$ dependency, in which the vertical axis represents the value of the input current $I_{in}$ or the output current $I_{out}$ and the horizontal axis represents the value of the PNP-type transistor.

The characteristic of each transistor is set as follows:

The emitter grounded current amplification factor $\beta_p$ of the NPN-type transistors Q5, Q6, and Q13 is set to 150 respectively.

The input current Iin generated by I1 and I10 is set to 50 [$\mu$A] respectively.

The value of the supply voltage $V_{CC}$ is set to 1.5 [V].

As shown in FIG. 7, the input current Iin shown by the line I is constantly kept at 50 [μA] independently of the fluctuation of the amplification $\beta_p$ because it is generated by the constant current sources I1 and I10.

For the existing circuit, the output current $I_{out}$ shown by the line II produces the error of approx. −15% to the input current Iin at the point of $\beta_p=20$.

For the circuit related to the present invention, however, the output current Iout produces the error of only approx. −2% to the input current $I_{in}$ at the point of $\beta_p=20$.

Therefore, for the circuit related to the present invention, the result is obtained from the simulation that the error of the output current $I_{out}$ to the input current $I_{in}$ and the emitter grounded current amplification factor dependency are small even for a small amplification factor $\beta_p$.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A semiconductor integrated circuit having an output terminal for supplying an output current to a load, comprising:

first and second power sources;

a first bipolar transistor having an emitter coupled to said first power source, a collector coupled to a first terminal, and a base;

a second bipolar transistor having an emitter coupled to said first power source, a collector coupled to a second terminal, and a base coupled to the collector of said second bipolar transistor and the base of said first bipolar transistor;

a third bipolar transistor having an emitter coupled to said first power source, a collector coupled to a third terminal, and a base coupled to a node between the collector of said first bipolar transistor and said first terminal;

a fourth bipolar transistor having an emitter coupled to said first power source, a collector coupled to said output terminal, and a base coupled to the base of said third transistor;

a current source coupled between said first terminal and said second power source; and a current mirror circuit having an input terminal coupled to said third terminal, an output terminal coupled to said second terminal, and a power source terminal coupled to said second power source.

2. The semiconductor integrated circuit according to claim 1, wherein said current mirror circuit comprises:

a fifth bipolar transistor having an emitter coupled to said second power source, a collector coupled to said third terminal, and a base coupled to the collector of said fifth bipolar transistor; and a sixth bipolar transistor having an emitter coupled to said second power source, a collector coupled to said second terminal, and a base coupled to the base of said fifth bipolar transistor.

3. The semiconductor integrated circuit according to claim 1, wherein an emitter area of said second bipolar transistor is N times as large as an emitter area of said first bipolar transistor, an emitter area of said fourth bipolar transistor is N times as large as an emitter area of said third bipolar transistor, and a current supplied to said second terminal is N times a current supplied to said third terminal.

4. The semiconductor integrated circuit according to claim 2, wherein an emitter area of said second bipolar transistor is N times as large as an emitter area of said first bipolar transistor, an emitter area of said fourth bipolar transistor is N times as large as an emitter area of said third bipolar transistor, and an emitter area of said sixth bipolar transistor is N times as large as an emitter area of said fifth bipolar transistor.

5. The semiconductor integrated circuit according to claim 1, further comprising:

a first resistor coupled between the emitter of said first bipolar transistor and said first power source;

a second resistor coupled between the emitter of said second bipolar transistor and said first power source;

a third resistor coupled between the emitter of said third bipolar transistor and said first power source; and a fourth resistor coupled between the emitter of said fourth bipolar transistor and said first power source.

6. The semiconductor integrated circuit according to claim 2, further comprising:

a first resistor coupled between the emitter of said first bipolar transistor and said first power source;

a second resistor coupled between the emitter of said second bipolar transistor and said first power source;

a third resistor coupled between the emitter of said third bipolar transistor and said first power source; and a fourth resistor coupled between the emitter of said fourth bipolar transistor and said first power source.

7. The semiconductor integrated circuit according to claim 2, further comprising:

a first resistor coupled between the emitter of said fifth bipolar transistor and said second power source; and a second resistor coupled between the emitter of said sixth bipolar transistor and said second power source.

8. The semiconductor integrated circuit according to claim 7, further comprising:

a third resistor coupled between the emitter of said first bipolar transistor and said first power source;

a fourth resistor coupled between the emitter of said second bipolar transistor and said first power source;

a fifth resistor coupled between the emitter of said third bipolar transistor and said first power source; and a sixth resistor coupled between the emitter of said fourth bipolar transistor and said first power source.

9. The semiconductor integrated circuit according to claim 1, wherein a collector-emitter voltage of said third bipolar transistor is substantially equal to a collector-emitter voltage of said fourth bipolar transistor.

10. The semiconductor integrated circuit according to claim 2, wherein a voltage drop between said third terminal and said second power source is substantially equal to a voltage drop between said output terminal and said second power source.

11. The semiconductor integrated circuit according to claim 10, wherein said load comprises:

a seventh bipolar transistor having an emitter coupled to said second power source, a collector coupled to said output terminal, and a base coupled to the collector of said seventh bipolar transistor; and an eighth bipolar transistor having an emitter coupled to said second power source, a collector, and a base coupled to the base of said seventh bipolar transistor.

12. The semiconductor integrated circuit according to claim 1, wherein said first, second, third, and fourth transistors are PNP-type bipolar transistors.

13. The semiconductor integrated circuit according to claim 11, further comprising:

a first resistor coupled between said second power source and the emitter of said seventh bipolar transistor; and a second resistor coupled between said second power source and the emitter of said eighth bipolar transistor.

14. The semiconductor integrated circuit according to claim 1, wherein said second power source comprises a low potential power source.

15. A semiconductor integrated circuit having an output terminal for supplying an output current to a load, comprising:

first and second power sources;

a first current mirror circuit having an input terminal, an output terminal, and a power source terminal coupled to said first power source;

a current source coupled between the output terminal of said first current mirror circuit and said second power source;

a second current mirror circuit having an input terminal, an output terminal coupled to the input terminal of said first current mirror circuit, and a power source terminal coupled to said second power source;

a first transistor having a first current terminal coupled to said first power source, a second current terminal coupled to the input terminal of said second current mirror circuit, and a control terminal connected to a node between the output terminal of said first current mirror circuit and said current source; and a second transistor having a first current terminal coupled to said first power source, a second current terminal coupled to said output terminal, and a control terminal coupled to the control terminal of said first transistor.

16. The semiconductor integrated circuit according to claim 15, wherein said first transistor is a bipolar transistor and said second transistor is a bipolar transistor.

* * * * *